US008109279B2

(12) United States Patent
Chudzik et al.

(10) Patent No.: US 8,109,279 B2
(45) Date of Patent: Feb. 7, 2012

(54) HAIR CLIP WITH FLEXING COMFORT FEATURES

(75) Inventors: Stan Chudzik, Alpharetta, GA (US); Michael Defenbaugh, Marietta, GA (US)

(73) Assignee: Goody Products, Inc., Atlanta, GA (US)

( * ) Notice: Subject to any disclaimer, the term of this patent is extended or adjusted under 35 U.S.C. 154(b) by 330 days.

(21) Appl. No.: 12/432,950

(22) Filed: Apr. 30, 2009

(65) Prior Publication Data

US 2009/0272398 A1 Nov. 5, 2009

Related U.S. Application Data

(60) Provisional application No. 61/049,115, filed on Apr. 30, 2008.

(51) Int. Cl.

| | |
|---|---|
| ***A45D 8/00*** | (2006.01) |
| ***A41F 1/00*** | (2006.01) |
| ***A41F 1/08*** | (2006.01) |
| ***A44B 1/04*** | (2006.01) |
| ***A44B 11/25*** | (2006.01) |
| ***A44B 17/00*** | (2006.01) |
| ***B42F 1/00*** | (2006.01) |

(52) U.S. Cl. ..... 132/277; 24/508

(58) Field of Classification Search ..... 132/277, 132/212, 219, 106, 107, 128, 129, 134, 135, 132/136, 137, 138, 139, 140, 144, 145, 146, 132/148, 149, 156, 273, 278, 279, 275, 282, 132/151; 24/509, 510, 511, 556, 546, 557, 24/558, 559, 331, 508

See application file for complete search history.

(56) References Cited

U.S. PATENT DOCUMENTS

| | | | | |
|---|---|---|---|---|
| 3,384,935 | A | 5/1968 | Salvador | |
| 4,343,321 | A * | 8/1982 | Caranicas | 132/276 |
| 5,533,533 | A * | 7/1996 | Shing | 132/279 |
| 5,862,815 | A * | 1/1999 | Murphy et al. | 132/277 |
| 5,881,741 | A * | 3/1999 | Chen | 132/277 |
| 6,446,639 | B1 | 9/2002 | Shyu | |
| 6,681,778 | B1 | 1/2004 | Salisbury et al. | |
| 6,755,440 | B1 * | 6/2004 | Jones | 280/822 |
| 7,299,808 | B2 * | 11/2007 | Lau | 132/277 |
| 2008/0156342 | A1 * | 7/2008 | Chininis et al. | 132/277 |
| 2008/0216861 | A1 * | 9/2008 | Shyu | 132/277 |
| 2009/0272397 | A1 * | 11/2009 | Defenbaugh et al. | 132/277 |

OTHER PUBLICATIONS

International Search Report for PCT application PCT/US2009/042219; 9 pages.

* cited by examiner

*Primary Examiner* — Todd Manahan
*Assistant Examiner* — Vanitha Elgart
(74) *Attorney, Agent, or Firm* — Lempia Summerfield Katz LLC

(57) ABSTRACT

A hair clip has two body members pivotally coupled together by a spring-biased hinge mechanism. Each body member has a handle section and a hair-gripping section with the hinge mounted between them. The hair clip can have at least one handle-deflecting opening in each handle section to form at least one handle-flexing region where the handle sections can deflect outwardly into a low-profile flexed position. A mechanical stop may be provided to limit inward deflection. The hair clip can also have at least one teeth-deflecting opening in each hair-gripping section to form at least one teeth-flexing region where the hair-gripping sections can deflect into a low-profile flexed position.

18 Claims, 7 Drawing Sheets

HAIR CLIP WITH FLEXING COMFORT FEATURES

CROSS-REFERENCE TO RELATED APPLICATION

This application claims the priority benefit of U.S. Provisional Patent Application Ser. No. 61/049,115, filed Apr. 30, 2008, the entire scope and content of which is hereby incorporated herein by reference.

TECHNICAL FIELD

The present invention relates generally to hairstyling accessories, and, in particular, to hair clips with user comfort features.

BACKGROUND OF THE INVENTION

Hair clips such as claw clips and jaw clips come in different designs and sizes, and are typically worn in the hair for different styling solutions. Conventional hair clips include two rigid body members (e.g., made of a hard plastic) that are pivotally coupled together by a spring-biased hinge. The body members each include a handle portion, a hair-gripping portion with teeth, and an intermediate portion therebetween where the rigid bodies are pivotally coupled together. When a user wearing such a hair clip rests her head back against a hard surface with the hair clip between her head and the surface, the rigid body tends to cause discomfort. The hard surface tends to cause the hair clip to dig into the wear's head, thereby causing the discomfort. This is a common problem that is especially an issue for women who wear hair clips to keep their hair out of the way while working out on exercise equipment, while riding in a car and resting their head back against the headrest, etc.

Accordingly, it can be seen that needs exist for improved hair clips that do not cause a wearer discomfort from resting her head back against a hard surface. It is to the provision of solutions to this and other problems that the present invention is primarily directed.

SUMMARY OF THE INVENTION

Generally described, the present invention provides a hair clip including two body members and a spring-biased hinge. The body members each have a handle section and a hair-gripping section (e.g., with teeth), and the hinge pivotally couples the body members together so that they pivot between a closed position and an open position. In addition, the hair clip includes one or more flexing comfort features that permit the hair clip to deflect when a wearer rests her head back against a hard surface, thereby reducing wearer discomfort. In some embodiments the hair clip includes only a handle-flexing comfort feature, in some embodiments the hair clip includes only a teeth-flexing comfort feature, and in some embodiments the hair clip includes both a handle-flexing comfort feature and a teeth-flexing comfort feature.

In an example handle-flexing comfort feature, each handle section includes at least one handle-deflecting opening in it to form at least one laterally adjacent handle-flexing region where the handle sections can deflect outwardly into a low-profile flexed position. In this way, when a wearer rests her head back against a hard surface, the hair clip deflects at the handle-flexing region to absorb some of the impact and thereby reduce wearer discomfort.

In an example embodiment, the handle-deflecting openings are provided by an elongated recess formed into a lateral thickness of each handle section. Each of the elongated recesses extends a lateral length of the respective handle section where there is any material (e.g., the handle sections may include central through-holes where there is no material). Also, the elongated recesses may be formed in inner surfaces of the handle sections.

Furthermore, the handle sections may include mechanical stops that limit inward deflection of the handle sections when the user presses the handle sections together inwardly and the handle sections begin to deflect inwardly. For example, if each of the handle-deflecting openings is provided by an elongated recess formed into a lateral thickness of the respective handle section through an inner surface of the handle section, then the mechanical stops may be provided by facing inner surfaces of the recess. The facing inner surfaces interfere with each other when the handle sections are pivoted together toward the open position and the handle sections begin to deflect inwardly. In addition, at least one extension member may be provided protruding into one of the recesses and defining one of the recess inner surfaces so that the recess inner surfaces interfere with each other sooner when the handle sections are pivoted together. Moreover, each of the handle sections may includes a built-up region or other protrusion into which the recess is formed to provide a larger surface area of the recess inner surfaces.

In an example teeth-flexing comfort feature, each hair-gripping section includes at least one teeth-deflecting opening in it to form at least one laterally adjacent teeth-flexing region where the hair-gripping sections can deflect into a low-profile flexed position. In this way, when a wearer rests her head back against a hard surface, the hair clip deflects at the teeth-flexing region to absorb some of the impact and thereby reduce wearer discomfort.

In an example embodiment, the handle-deflecting openings are provided by a single elongated through-opening extending through a lateral thickness of each of the respective hair-gripping sections. Each of the hair-gripping sections includes two outer-positioned side portions with the respective elongated opening centrally formed between them such that the side portions define the teeth-flexing regions. Furthermore, each of the hair-gripping sections may include teeth, and each of the elongated handle-deflecting openings may extend laterally longer than the teeth or the handle section.

The specific techniques and structures employed by the invention to improve over the drawbacks of the prior devices and methods and accomplish the advantages described herein will become apparent from the following detailed description of the example embodiments of the invention and the appended drawings and claims.

DETAILED DESCRIPTION OF EXAMPLE EMBODIMENTS OF THE INVENTION

Figure 2:
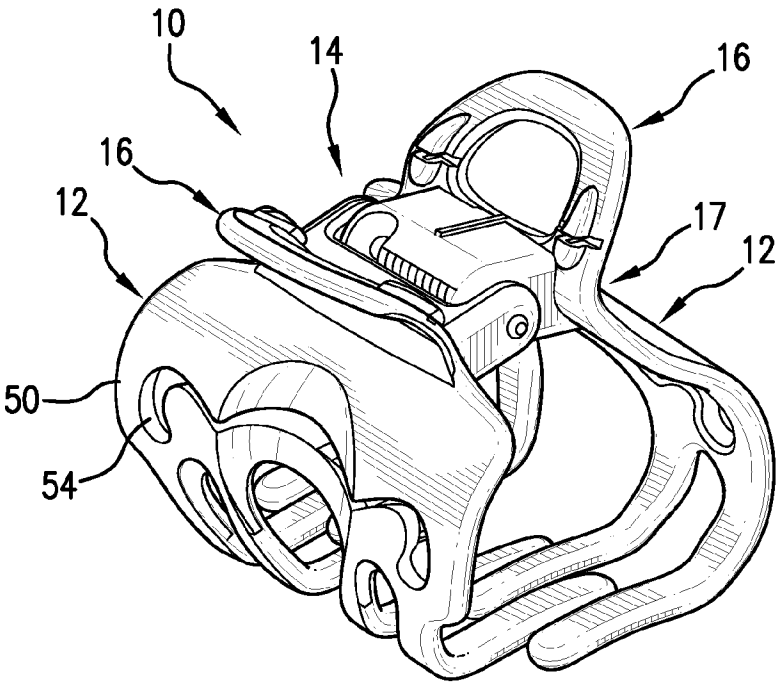
FIG. 2 is a left perspective view of the hair clip of FIG. 1.
Figure 1:
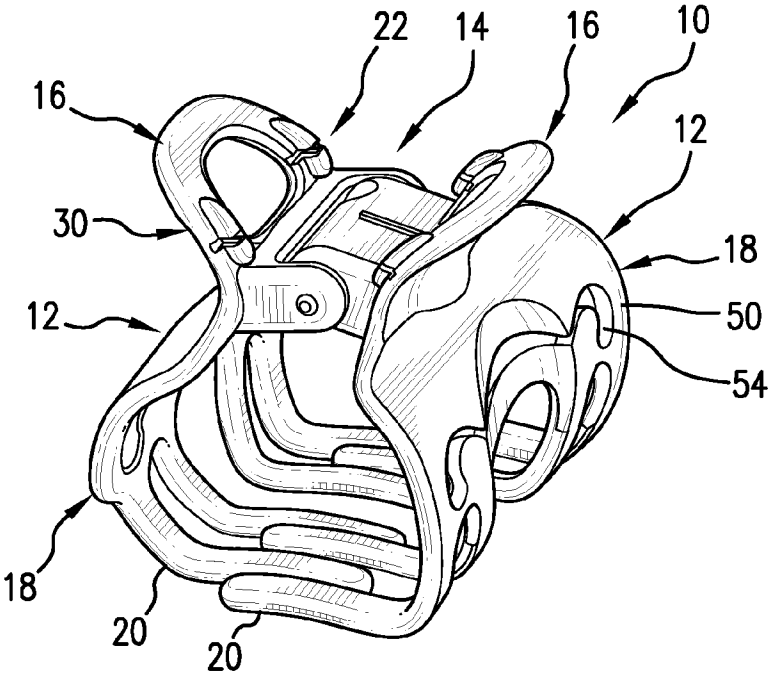
FIG. 1 is a right perspective view of a hair clip according to a first example embodiment of the present invention, showing first and second example flexing comfort features.

Generally described, the present invention provides a hair clip having two body members that are pivotally coupled together by a spring-biased hinge mechanism. The hair clip includes one or more flexing comfort features that permit the body members to deflect dynamically upon impact with a hard surface so that they do not dig into the wearer's head, thereby reducing wearer discomfort.

FIGS. 1-10 show a hair clip 10 according to an example embodiment of the present invention. The hair clip 10 has two body members 12 that are pivotally coupled together by a spring-biased hinge mechanism 14. The body members 12 each include a handle section 16, a hair-gripping section 18, and an intermediate section 17 between the handle and hair-gripping sections. Each hair-gripping section 18 includes a plurality of hair-gripping teeth 20. The spring-biased hinge mechanism 14 may be of a conventional type or it may be provided by a concealed-spring hinge mechanism such as that disclosed in a U.S. patent application filed on the same date as this application and titled "Hair Clip With Concealed Hinge Spring," which is hereby incorporated herein by reference in its entirety. The handle sections 16 are designed for the user to grip and press together against the biasing force of the spring-biased hinge mechanism 14 to pivot the hair-gripping sections 18 from a closed/in-use position with the teeth 20 interposed with each other (see FIG. 1) to an open position with the teeth 20 moved apart from each other. In the closed position the teeth 20 cooperate to engage and hold the wearer's hair in a pre-arranged style, and in the open position the hair clip 10 can be placed into or removed from the hair.

Figure 4:
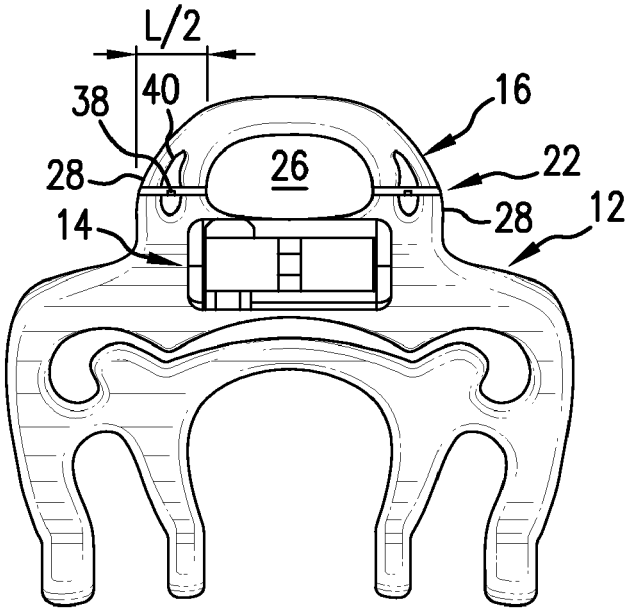
FIG. 4 is a left side view of the inside of the right-side body member of the hair clip of FIG. 1, showing details of a handle-deflecting opening and a handle-flexing region of the first example flexing comfort feature.
Figure 5:
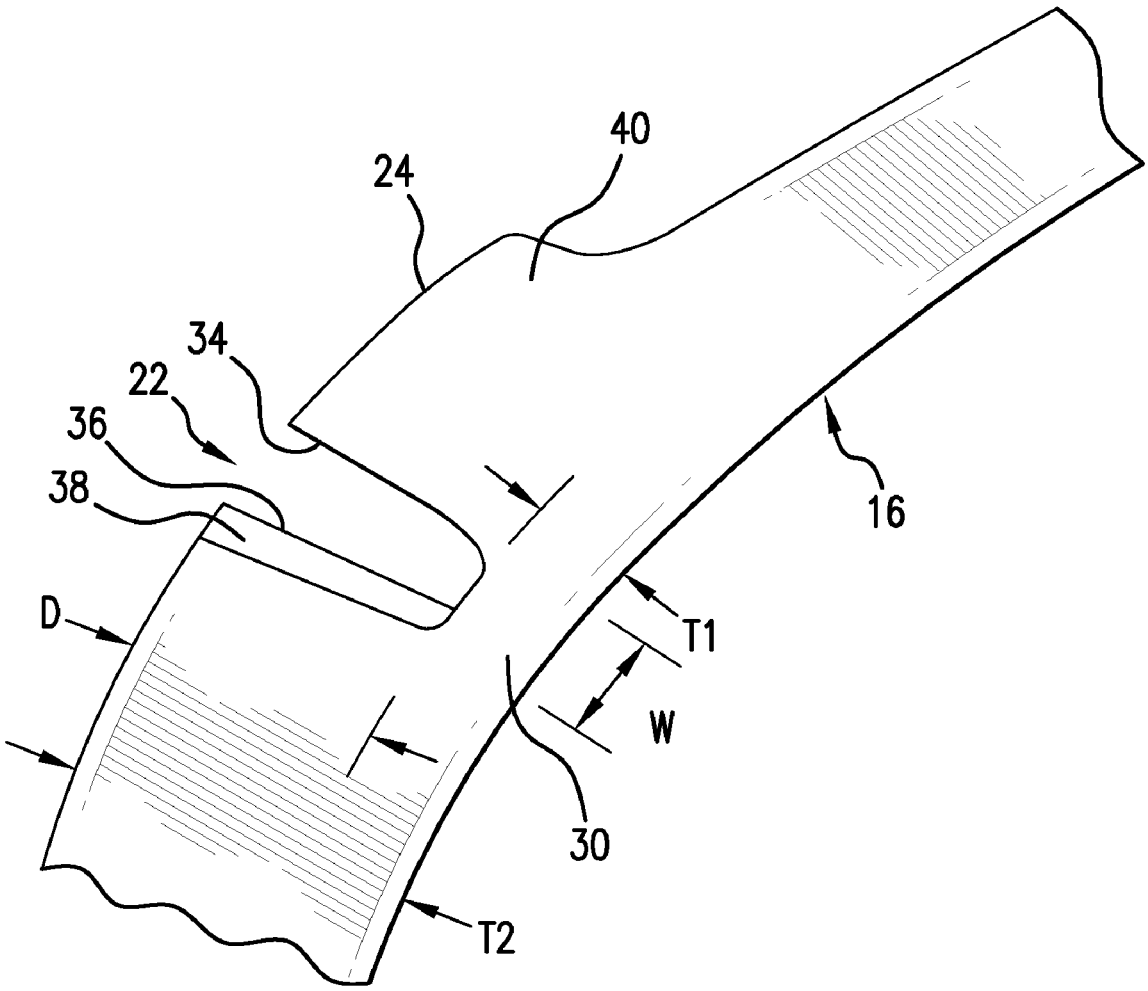
FIG. 5 is a detail side view of a portion of a handle of the body member of FIG. 4, showing additional details of the first example flexing comfort feature.
Figure 6:
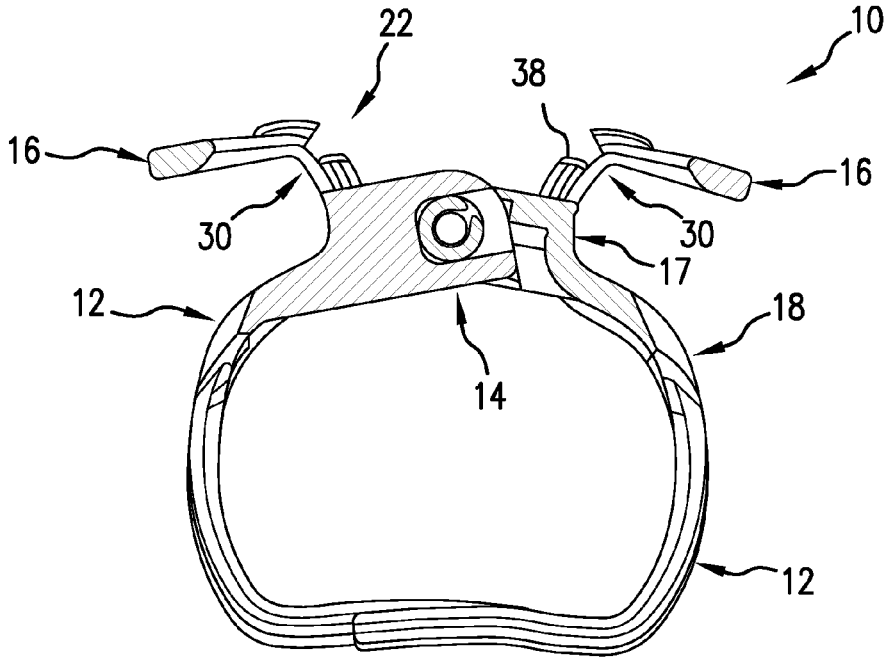
FIG. 6 is a cross-sectional view of the hair clip of FIG. 1, showing the handles deflected outwardly to a low-profile flexed position.
Figure 7:
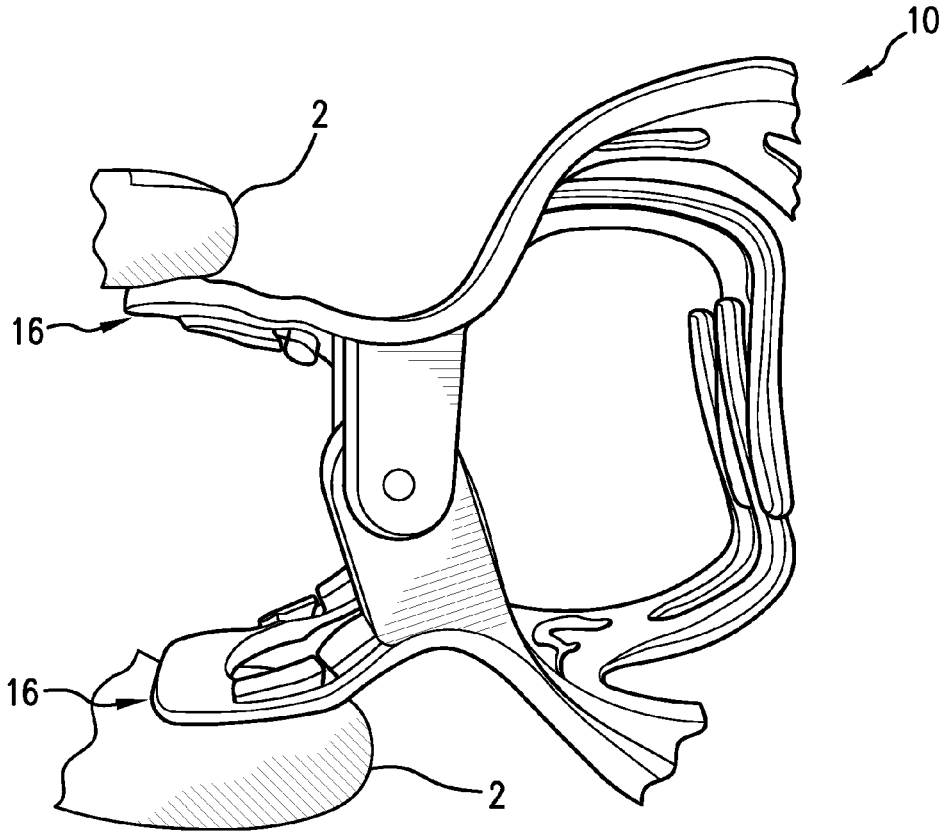
FIG. 7 is a side view of a portion of the hair clip of FIG. 1, showing mechanical stops limiting the handles moving inward when the hair clip is being opened.

FIGS. 1-7 show details of a first example flexing comfort feature of the present invention. The handle sections 16 each include at least one handle-deflecting opening 22 and at least one flexing region 30 laterally adjacent the handle-deflecting openings. In other words, the flexing region 30 is the thinned part of the handle section 16 left thinner because of the laterally adjacent handle-deflecting opening 22. The flexing regions 30 are made of a material and have a thickness T1 laterally adjacent the handle-deflecting openings 22 (see FIG. 5) that are selected to permit the handle sections to deflect (but not break during the normal course of use during the typical life of hair clips) at the flexing regions. In this way, when a hard surface comes into contact with the handle sections 16 (e.g., when a wearer rests her head back against the hard surface), the handle sections flex at the flexing regions 30 and deflect outwardly (away from each other) into a low-profile position (as shown in FIG. 6). In typical commercial embodiments, the handle-deflecting openings 22 are positioned adjacent the intermediate sections 17, or at least closer to the hinge mechanism 14 than the free upper ends of the handle sections 16, so that all or at least a substantial portion of the lengths of the handle sections swing outwardly when the flexing regions 30 deflect.

In the depicted embodiment, the handle-deflecting openings 22 are provided by recesses that are formed in the inner surfaces 24 of the handle sections 16, that extend a recess depth D into the thickness T2 of the handle sections, that extend a recess width W into the handle sections, and that extend the entire length L of that portion of the handle sections where there is any material (see FIGS. 4 and 5). In the embodiment depicted in FIG. 4, the handle sections 16 each have a central through-hole 26, with the handle-deflecting recesses 22 formed in two side-portions 28 of the handle sections defined by the central through-hole. In an alternative embodiment, the handle sections are provided by solid members without through-holes. And in other alternative embodiments, the handle sections have multiple through-holes defining mid-portions as well as side-portions. In any case, the handle-deflecting recesses 22 extend the entire length of the handle sections 16 (e.g., through the handle side-portions and the through-hole-where there is no material anyway, through the solid handle, through the handle side-portions, mid-portions, and through-holes, etc.). In yet another alternative embodiment, the handle sections have handle-deflecting openings formed in their outer surfaces (not facing each other) in addition or alternatively to having handle-deflecting openings formed in their inner surfaces.

As shown in FIGS. 4 and 5, in typical commercial embodiments the handle-deflecting openings 22 are provided by elongated recesses (i.e., channels) having a generally rectangular profile/shape, a recess depth D of about 1.5 mm-2.0 mm, and a recess width W of about 0.80 mm-1.0 mm. The flexing region 30 has a thickness T1 of about 1.0 mm, a width W of about 0.80 mm-1.0 mm, and a length L of about 4.0 mm-5.0 mm. The length L is the total length of the handle sections 16 where there is any material, i.e., the cumulative length of the depicted side-portions 28, so each of the two depicted side-portions has a length L/2 of about 2.0 mm-2.5 mm. These dimensions are provided for illustration purposes only and are not intended to be limiting of the invention, and it is within the capability of persons of ordinary skill in the art to use other dimensions than those provided herein. Accordingly, alternative embodiments contemplated by the present invention include hair clips with different dimensions and arrangements of the handle-deflecting openings and flexing regions than those expressly set forth herein. In such alternative embodiments, the handle-deflecting openings are provided by recesses with a semi-circular, triangular, or other regular or irregular profile/shape, are provided by a series of elongated recesses spaced apart on the handle from adjacent the intermediate section out toward the outer free ends, and/or are provided by a series or array of through-holes extending all the way through the thickness of the handle sections but not extending the entire length of the handle sections (e.g., they form perforated flexing regions).

In order to prevent the flexing regions 30 of the handle sections 16 from deflecting too much (i.e., such that the hair clip 10 cannot be opened) when a user presses inward (toward each other) on the handle sections to open the hair clip, the handle flexing regions may include mechanical stops. In the depicted embodiment, for example, the mechanical stops are provided by first and second facing inner surfaces 34 and 36 of the handle-deflecting openings 22 that interfere with each other when the user presses the handle sections 16 together inwardly and the handle sections begin to deflect inwardly. In alternative embodiments, the mechanical stops are provided by posts, wedges, bars, or other interference members extending inwardly from the handles and positioned with the handle-deflecting openings between them.

Figure 3:
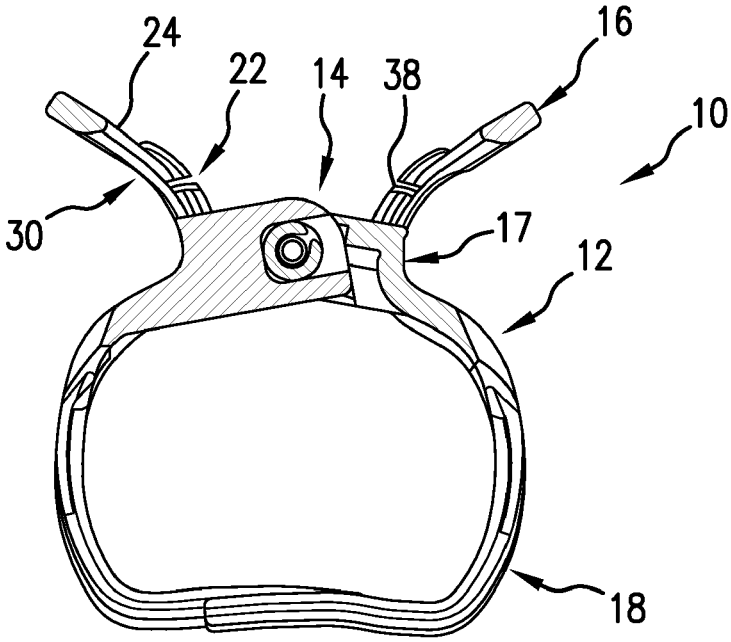
FIG. 3 is a cross-sectional view of the hair clip of FIG. 1.

In order to provide a sufficiently large width W of the flexing region 30 to permit the handle sections 16 to deflect readily as desired, one or both of the first and second inner surfaces 34 and 36 may be defined by extension members 38 that protrude into the handle-deflecting openings 22 (see FIGS. 3-5). The extension members 38 may be provided by rectangular ridges, as depicted, or by bars, posts, a series of protrusions, or other inwardly extending structures in the handle-deflecting openings. In this way, the first and second inner surfaces 34 and 36 interfere with each other sooner, thereby permitting less inward deflection by the handle sections 16. In another embodiment, the extension members 38 have a larger width (e.g., cumulatively they may be as wide or almost as wide as the width W of the handle-deflecting openings 22) so that the first and second inner surfaces 34 and 36 are immediately adjacent each other or contact each other when the hair clip 10 is in the closed position.

In addition, the handle sections 16 may include protrusions 40 (see FIGS. 4-5) into which the handle-deflecting recesses 22 are formed to thereby provide a greater thickness T2 and larger first and second inner surfaces 34 and 36, which in turn thereby provides for stronger mechanical stops. The protrusions 40 may be provided by built-up regions extending inwardly from the handle sections 16 with the handle-deflecting recesses 22 between them, as depicted, or by ribs, ridges, posts, or other structures extending inwardly from the handle sections.

Accordingly, the handle sections 16 are able to fold down flat in one direction (outwardly apart) to a low-profile flexed position when the user rests her head back against a hard surface (see FIG. 6). But the mechanical stops (i.e., "brakes") will engage each other when the user presses (e.g., with her fingers 2) the handle sections 16 in the opposite direction (inwardly together), thereby minimizing handle deflection and permitting the hair clip to be opened (see FIG. 7).

The hair clip 10 can be made by conventional manufacturing techniques using conventional materials. For example, in typical commercial embodiments the body members 12 are injection molded of a soft plastic such as acrylonitrile butadiene styrene (ABS), nylon, polypropylene (PP), polyethylene (PE), acrylic, polyvinyl chloride (PVC), or another elastically deformable, resilient material. The design of the handle sections 16, with the handle-deflecting openings 22 and the flexing regions 30, inherently allows for some deflection as long as a material permitting a minimal amount of resilient, elastic deformation is used. In some embodiments, the entire body members are made of the same resilient, elastically deformable material. In some other embodiments, the flexing regions are made of the resilient, elastically deformable material, and the remainder of the body members is made of a rigid material (e.g., hard plastic). In still other embodiments, the flexing regions and the portions of the handle sections immediately adjacent them are made of the resilient, elastically deformable material, and the remainder of the body members is made of a rigid material (e.g., hard plastic). And in yet still other embodiments, the inwardly protruding ribs are made of a rigid material (e.g., hard plastic) to provide the mechanical stops, and the remainder of the body members is made of the resilient, elastically deformable material to permit the desired outward deflection.

Figure 10:
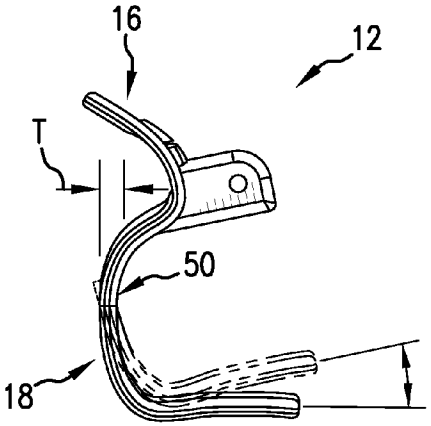
FIG. 10 is a left side view of the body member of FIG. 8, showing the hair-gripping section deflecting to and from a low-profile flexed position.
Figure 9:
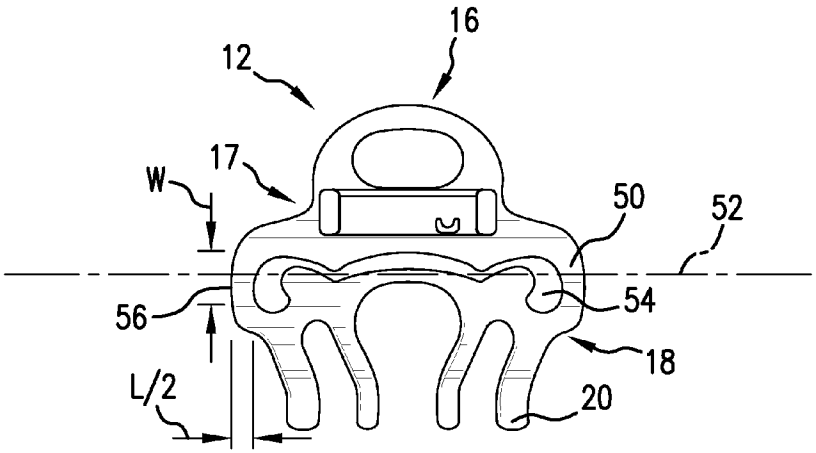
FIG. 9 is a front view of the body member of FIG. 8, showing details of a teeth-deflecting opening and a teeth-flexing region of the second example flexing comfort feature.
Figure 8:
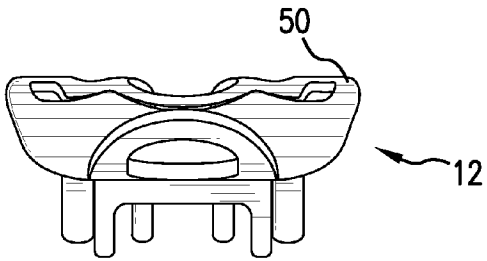
FIG. 8 is a top view of the left-side body member of the hair clip of FIG. 1, showing the second example flexing comfort feature.

FIGS. 8-10 show details of a second example flexing comfort feature. The hair-gripping sections 18 each include at least one teeth-deflecting opening 54 and at least one flexing region 50 laterally adjacent the teeth-deflecting opening. In other words, the flexing region 50 is the part of the hair-gripping section 18 that is laterally adjacent the teeth-deflecting opening 54 and that has less material because of the teeth-deflecting opening. The flexing regions 50 are made of a material and have a thickness T adjacent the handle-deflecting openings 54 that are selected to permit the hair-gripping sections 18 to deflect (but not break during the normal course of use during the typical life of hair clips) at the flexing regions (see FIG. 10). Generally, the flexing regions 50 flex along a flexing line 52 to deflect the teeth 20 to a low-profile flexed position (shown in phantom lines in FIG. 10) when the user rests her head back against a hard surface. In this way, when a hard surface comes into contact with the handle sections 16 and they flex, the hair-gripping sections 18 also can deflect some (about the flexing line 52) to further reduce discomfort to the wearer. It should be noted that this second example flexing comfort feature, with its flexing region 50 and teeth-deflecting opening 54, may be combined in a hair clip 10 with the first example flexing comfort feature, with its flexing region 30 and handle-deflecting opening 22, or these two flexing comfort features may be provided individually in separate hair clips.

In typical commercial embodiments, the teeth-deflecting openings 54 are positioned in the hair-gripping sections 18 between the intermediate section 17 and the teeth 20. The teeth-deflecting openings 54 may be provided by a single elongated through-opening in each hair-gripping sections that is laterally longer than the teeth or the handle section and that has a decorative shape, for example as shown in FIG. 9. In alternative embodiments in which the teeth-deflecting openings extend through the thickness T of the hair-gripping sections (from the inner to the outer surfaces), they are generally elongated and rectangular, are provided by a series or array of through-openings, and/or have another regular or irregular shape such as a semi-circular or triangular shape.

In the depicted embodiment, the teeth-deflecting openings 54 are provided by centrally positioned through-holes that extend all the way through the thickness T of the hair-gripping sections 18 and that have a length and width defining the flexing regions 50 as side-portions of the hair-gripping sections, with the side-portion flexing regions having a width W and a cumulative length L. In typical commercial embodiments, there are at least two side-portion flexing regions 50, with the two side-portions at the outer edges of the hair-gripping sections 18 and the teeth-deflecting opening 54 therebetween. This arrangement minimizes any rotation of the hair-gripping sections about an axis that is perpendicular to the plane of the page on which FIG. 8 is drawn. In the depicted embodiment, the two side-portion flexing regions 50 have the same length, with each side-portion having a length of L/2, thought they need not have the same length.

In typical commercial embodiments, the flexing regions 50 have a thickness T of about 1.8 mm-2.0 mm and the teeth-deflecting openings 54 define the flexing regions with a width W of about 1.25 mm-8.0 mm and a length L of about 4.0 mm-5.0 mm. The length L is the length of the hair-gripping sections 18 where there is any material (i.e., the cumulative length of the side-portion flexing regions 50, or the overall length of the hair-gripping sections less the length of the teeth-deflecting openings 54 along the flexing lines 52). So each of the two depicted side-portion flexing regions 50 has a length L/2 of about 2.0 mm-2.5 mm. These dimensions are provided for illustration purposes only and are not intended to be limiting of the invention, and it is within the capability of persons of ordinary skill in the art to use other dimensions than those provided herein. Accordingly, alternative embodiments contemplated by the present invention include hair clips with different dimensions and arrangements of the teeth-deflecting openings and teeth-flexing regions than those expressly set forth herein.

In some such alternative embodiments, the teeth-deflecting openings are provided by recesses with a semi-circular, triangular, or other regular or irregular shape, are provided by a series of elongated recesses (e.g., channels) spaced apart on the hair-gripping from adjacent the intermediate section out toward the outer free ends of the teeth, and/or are provided by a series or array of through-holes extending all the way through the thickness of the hair-gripping sections but not extending the entire length of the hair-gripping sections (e.g., they form perforated flexing regions). In alternative embodiments in which the teeth-deflecting openings are provided by recesses in the lateral thickness of the hair-gripping sections, mechanical stops (e.g., of the type described above) may be provided that limit outward/apart deflection while permitting inward/together deflection to the low-profile flexed position. In other alternative embodiments, the teeth-deflecting openings extend only a portion of the way through the lateral thickness T of the hair-gripping sections and extend the entire lateral length of the hair-gripping sections (e.g., they are formed by one or more elongated recesses similar to the handle-deflecting openings described herein), and/or more than one of them is formed on each of the handle sections.

The hinge mechanism 14 creates a spring-biased tension on the hair-gripping sections 18, which are able to flex somewhat (particularly the teeth 20) independent of the flexing regions 50. That is, the hair-gripping sections 18 of typical embodiments allow for some amount of deflection under loading or impact. This is particularly the case when fabricating the body members 12 of a resilient, elastically deformable material, as described above. In some embodiments, the flexing regions are made of the resilient, elastically deformable material, and the remainder of the body members (or at least the remainder of the hair-gripping sections) is made of a rigid material (e.g., hard plastic).

Figure 11:
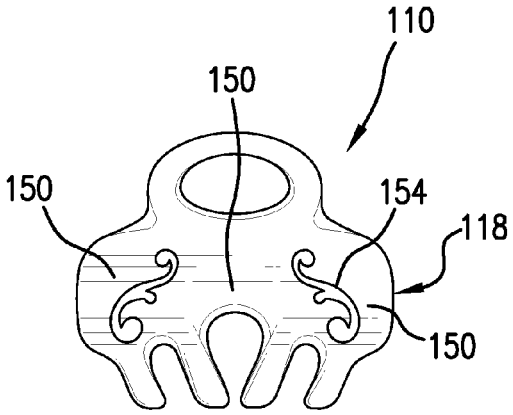
FIG. 11 is a side view of a hair clip according to a second example embodiment with a different teeth-deflecting opening and flexing region arrangement.
Figure 12:
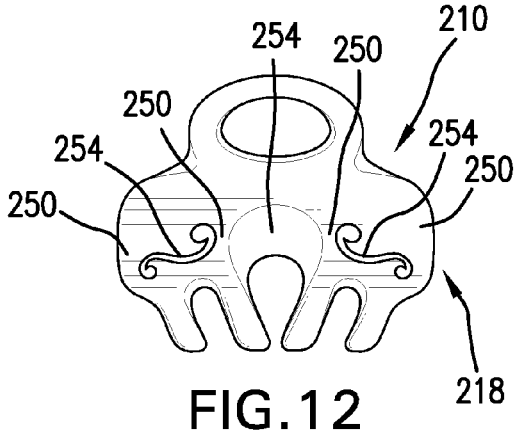
FIG. 12 is a side view of a hair clip according to a third example embodiment with a different teeth-deflecting opening and flexing region arrangement.
Figure 13:
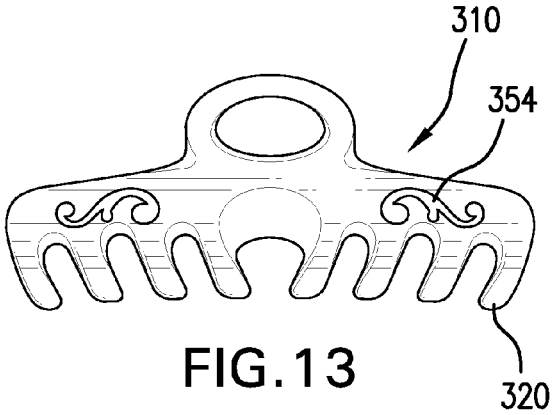
FIG. 13 is a side view of a hair clip according to a fourth example embodiment with a different teeth-deflecting opening and flexing region arrangement.
Figure 14:
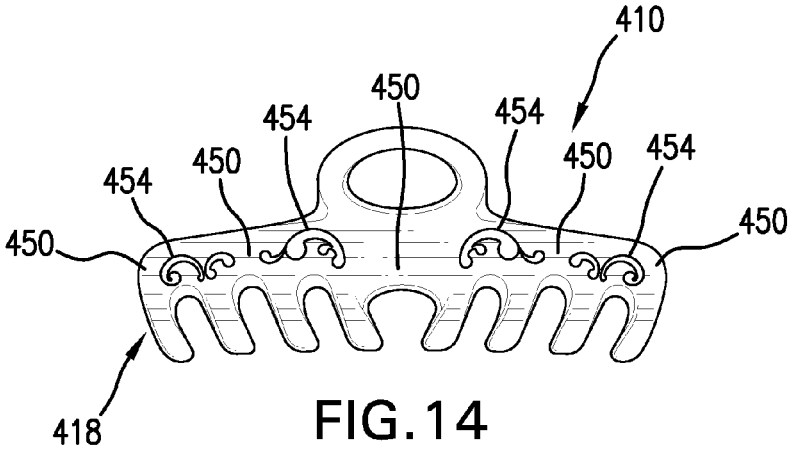
FIG. 14 is a side view of a hair clip according to a fifth example embodiment with a different teeth-deflecting opening and flexing region arrangement.
Figure 15:
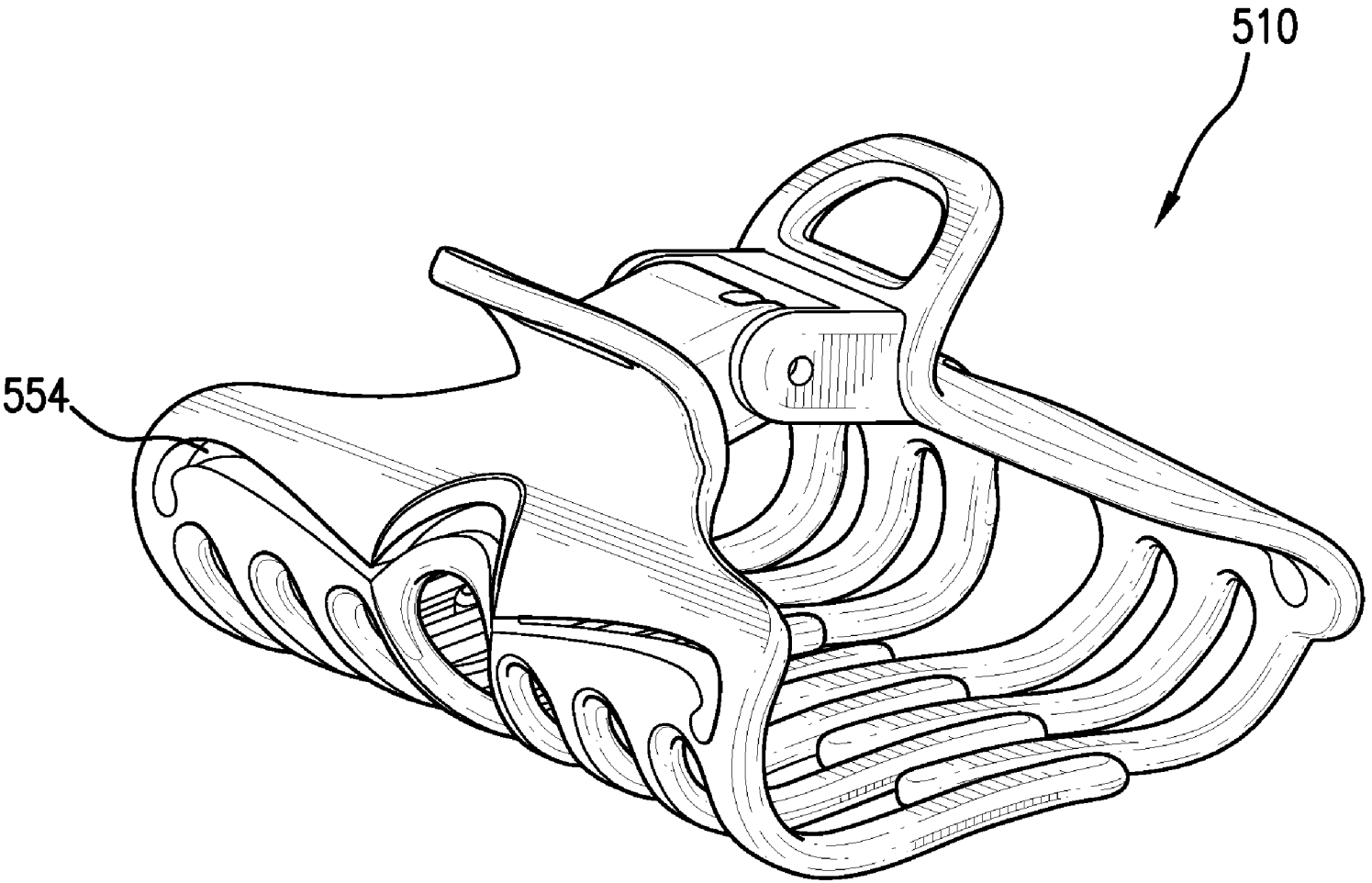
FIG. 15 is a side view of a hair clip according to a sixth example embodiment with a different teeth-deflecting opening and flexing region arrangement.

FIGS. 11-17 show hair clips according to additional example embodiments of the present invention. In these embodiments, the hair clips have different ornamental shapes of the teeth-deflecting openings, different numbers of the teeth-deflecting openings, and/or different numbers/arrangements of teeth. In particular, FIG. 11 shows a hair clip 110 according to a second example embodiment that is similar to that of the first example embodiment, except this hair clip has two teeth-deflecting openings 154 forming the hair-gripping section 118 into three flexing regions 150, with the teeth-deflecting openings having a different decorative shape. FIG. 12 shows a hair clip 210 according to a third example embodiment that is similar to that of the above-described example embodiments, except this hair clip has three teeth-deflecting openings 254 forming the hair-gripping section 218 into four flexing regions 250, with the teeth-deflecting openings having a different decorative shape. FIG. 13 shows a hair clip 310 according to a fourth example embodiment that is similar to that of the third example embodiment, except this hair clip has eight teeth 320 instead of four and the teeth-deflecting openings 354 have a different decorative shape. FIG. 14 shows a hair clip 410 according to a fifth example embodiment that is similar to that of the fourth example embodiment, except this hair clip has four teeth-deflecting openings 454 forming the hair-gripping section 418 into five flexing regions 450, with the teeth-deflecting openings having decorative shapes that are different from the other example embodiments. In addition, the teeth-deflecting openings 454 of this hair clip 410 are not all of the same shape, and instead the openings of each side generally match symmetrically those of the other side. And FIG. 15 shows a hair clip 510 according to a sixth example embodiment that is similar to that of the first example embodiment, except this hair clip has eight teeth 520 instead of four, with the teeth-deflecting openings 554 having the same decorative shape.

In other alternative embodiments, the present invention includes hair clips other than the depicted claw clips that have the same or similar comfort features. Such other hair clips include jaw clips, barrettes, etc. Persons skilled in the art will understand how to modify such hair clip designs to incorporate the comfort features disclosed herein. For example, in an alternative embodiment in which the hair clip is a barrette, the hair-gripping sections of the body members to not include the teeth of the embodiments described herein.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

What is claimed is:

1. A hair clip, comprising:

two body members each having a handle section and a hair-gripping section with teeth; and a spring-biased hinge pivotally coupling the body members together and permitting the body members to pivot between a closed position and an open position, wherein the handle sections each include at least one handle-deflecting opening and at least one handle-flexing region laterally adjacent the handle-deflecting opening that are adapted to permit the handle sections to deflect outwardly at the handle-flexing region into a low-profile flexed position when the hair clip is in the closed position, wherein the handle sections include mechanical stops that limit inward deflection of the handle sections, wherein each of the handle-deflecting openings is provided by an elongated recess formed into a lateral thickness of the respective handle section through an inner surfaces of the handle section, and the mechanical stops are provided by facing inner surfaces of the recess that interfere with each other when the handle sections are pivoted together toward the open position and the handle sections begin to deflect inwardly, and wherein the hair-gripping sections each include at least one teeth-deflecting opening and at least one teeth-flexing region laterally adjacent the teeth-deflecting opening that are adapted to permit the hair-gripping sections to deflect at the teeth-flexing region into a low-profile flexed position when the hair clip is in the closed position.

2. The hair clip of claim 1, wherein each of the handle-flexing regions is made of a resilient, elastically deformable material.

3. The hair clip of claim 1, wherein each of the handle-deflecting openings is provided by an elongated recess formed into a lateral thickness of the handle section.

4. The hair clip of claim 3, wherein each of the elongated recesses extends a lateral length of the respective handle section where there is any material.

5. The hair clip of claim 3, wherein the elongated recesses are formed in inner surfaces of the handle sections.

6. The hair clip of claim 3, wherein each of the handle sections includes a central through-hole and two outer-positioned side portions, the elongated recesses are formed in the side portions, and the side portions define the handle-flexing regions.

7. The hair clip of claim 1, further comprising at least one extension member protruding into one of the recesses and defining one of the recess inner surfaces so that the recess inner surfaces interfere with each other sooner when the handle sections are pivoted together.

8. The hair clip of claim 1, wherein each of the handle sections includes a protrusion into which the respective recess is formed to provide a larger surface area of the recess inner surfaces.

9. The hair clip of claim 8, wherein the protrusions are formed by built-up regions extending inwardly from the handle section inner surfaces.

10. The hair clip of claim 1, wherein each of the teeth-flexing regions is made of a resilient, elastically deformable material.

11. The hair clip of claim 1, wherein each of the teeth-deflecting openings is provided by a single elongated through-opening extending through a lateral thickness of the respective hair-gripping section.

12. A hair clip, comprising:

two body members each having a handle section and a hair-gripping section with teeth; and a spring-biased hinge pivotally coupling the body members together and permitting the body members to pivot between a closed position and an open position, wherein the handle sections each include at least one handle-deflecting opening and at least one handle-flexing region laterally adjacent the handle deflecting opening that are adapted to permit the handle sections to deflect outwardly at the handle-flexing region into a low-profile flexed position when the hair clip is in the closed position, wherein the hair-gripping sections each include at least one teeth-deflecting opening and at least one teeth-flexing region laterally adjacent the teeth-deflecting opening that are adapted to permit the hair-gripping sections to deflect at the teeth-flexing region into a low-profile flexed position when the hair clip is in the closed position, wherein each of the teeth-deflecting openings is provided by a single elongated through-opening extending through a lateral thickness of the respective hair-gripping section, and wherein each of the hair-gripping sections includes two outer-positioned side portions with the respective elongated teeth-deflecting opening centrally formed therebetween, wherein the side portions define the teeth-flexing regions.

13. The hair clip of claim 12, wherein each of the hair-gripping sections includes teeth and each of the elongated teeth-deflecting openings extends laterally longer than the respective teeth or the respective handle section.

14. A hair clip, comprising:

two body members each having a handle section and a hair-gripping section with teeth; and a spring-biased hinge pivotally coupling the body members together and permitting the body members to pivot between a closed position and an open position, wherein the handle sections each include at least one handle-deflecting opening and at least one handle-flexing region laterally adjacent the handle-deflecting opening that are adapted to permit the handle sections to deflect outwardly at the handle-flexing region into a low-profile flexed position when the hair clip is in the closed position, wherein the handle sections include mechanical stops that limit inward deflection of the handle sections, wherein each of the handle-deflecting openings is provided by an elongated recess formed into a lateral thickness of the respective handle section through an inner surface of the handle section, and the mechanical stops are provided by facing inner surfaces of the recess that interfere with each other when the handle sections are pivoted together toward the open position and the handle sections begin to deflect inwardly, and wherein each of the handle-flexing regions is made of a resilient, elastically deformable material.

15. The hair clip of claim 14, wherein each of the handle-deflecting openings is provided by an elongated recess formed into a lateral thickness of the handle section, wherein each of the elongated recesses extends a lateral length of the respective handle section where there is any material, wherein the elongated recesses are formed in inner surfaces of the handle sections, and wherein the handle sections include mechanical stops that limit inward deflection of the handle sections.

16. The hair clip of claim 14, wherein the hair-gripping sections each include at least one teeth-deflecting opening and at least one teeth-flexing region laterally adjacent the teeth-deflecting opening that are adapted to permit the hair-gripping sections to deflect at the teeth-flexing region into a low-profile flexed position when the hair clip is in the closed position.

17. A hair clip, comprising:

two body members each having a handle section and a hair-gripping section with teeth; and a spring-biased hinge pivotally coupling the body members together and permitting the body members to pivot between a closed position and an open position, and wherein the hair-gripping sections each include at least one elongated teeth-deflecting opening and teeth-flexing regions laterally adjacent the teeth-deflecting opening that are adapted to permit the hair-gripping sections to deflect at the teeth-flexing region into a low-profile flexed position when the hair clip is in the closed position, wherein each of the hair-gripping sections includes two outer-positioned side portions with the respective elongated teeth-deflecting opening centrally formed therebetween, wherein the side portions define the teeth-flexing regions, and wherein each of the teeth-flexing regions is made of a resilient, elastically deformable material.

18. A hair clip, comprising:

two body members each having a handle section and a hair-gripping section with teeth; and a spring-biased hinge pivotally coupling the body members together and permitting the body members to pivot between a closed position and an open position, and wherein the hair-gripping sections each include at least one teeth-deflecting opening and at least one teeth-flexing region laterally adjacent the teeth-deflecting opening that are adapted to permit the hair-gripping sections to deflect at the teeth-flexing region into a low-profile flexed position when the hair clip is in the closed position, wherein each of the teeth-deflecting openings is provided by a single elongated through-opening extending through a lateral thickness of the respective hair-gripping section, wherein each of the hair-gripping sections includes two outer-positions side portions with the respective elongated teeth-deflecting opening centrally formed therebetween, wherein the side portions define the teeth-flexing regions, and wherein each of the hair-gripping sections includes teeth and each of the elongated teeth-deflecting openings extends laterally longer than the respective teeth or the respective handle section.

* * * * *

UNITED STATES PATENT AND TRADEMARK OFFICE

CERTIFICATE OF CORRECTION

PATENT NO. : 8,109,279 B2
APPLICATION NO. : 12/432950
DATED : February 7, 2012
INVENTOR(S) : Stan Chudzik et al.

It is certified that error appears in the above-identified patent and that said Letters Patent is hereby corrected as shown below:

Column 9, claim 1, line 3, please replace “surfaces” with --surface--.

Signed and Sealed this
Twenty-second Day of May, 2012

David J. Kappos

David J. Kappos
*Director of the United States Patent and Trademark Office*